US006124040A

United States Patent [19]

Kolaska et al.

[11] Patent Number: 6,124,040

[45] Date of Patent: Sep. 26, 2000

[54] COMPOSITE AND PROCESS FOR THE PRODUCTION THEREOF

[75] Inventors: Hans Kolaska, Bottrop; Monika Willert-Porada, Dortmund; Klaus Rödiger, Bochum; Thorsten Gerdes, Dortmund, all of Germany

[73] Assignee: Widia GmbH, Essen, Germany

[21] Appl. No.: 08/945,561

[22] PCT Filed: Apr. 26, 1995

[86] PCT No.: PCT/DE95/00548

§ 371 Date: Nov. 20, 1997

§ 102(e) Date: Nov. 20, 1997

[87] PCT Pub. No.: WO96/33830

PCT Pub. Date: Oct. 31, 1996

[51] Int. Cl.[7] ..... B22F 3/105; B01J 19/12; C22C 29/00

[52] U.S. Cl. ..... 428/472; 428/469; 428/697; 428/698; 428/699; 75/241; 75/242; 75/255

[58] Field of Search ..... 428/457, 469, 428/697, 699, 698; 75/236, 237, 241, 242, 255

[56] References Cited

U.S. PATENT DOCUMENTS

| | | | |
|---|---|---|---|
| 4,145,213 | 3/1979 | Oskarsson et al. . | |
| 4,447,263 | 5/1984 | Sugizawa et al. . | |
| 4,501,717 | 2/1985 | Tsukamoto et al. | 419/58 |
| 4,684,405 | 8/1987 | Kolaska et al. | 75/241 |
| 4,830,930 | 5/1989 | Taniguchi et al. | 75/230 |
| 4,919,718 | 4/1990 | Tiegs et al. | 75/240 |
| 5,010,220 | 4/1991 | Apte et al. . | |
| 5,072,087 | 12/1991 | Apte et al. . | |
| 5,223,020 | 6/1993 | Kolaska | 75/238 |
| 5,397,530 | 3/1995 | Narashimhan et al. . | |

FOREIGN PATENT DOCUMENTS

| | | |
|---|---|---|
| 377 786 | 4/1985 | Austria . |
| 00 46 209 | 2/1982 | European Pat. Off. . |
| 0 219 231 | 4/1987 | European Pat. Off. . |
| 0 374 358 | 6/1990 | European Pat. Off. . |
| 0 382 530 | 8/1990 | European Pat. Off. . |
| 0 417 333 | 3/1991 | European Pat. Off. . |
| 0 476 346 | 3/1992 | European Pat. Off. . |
| 0 503 082 | 9/1992 | European Pat. Off. . |
| 515 431 | 11/1992 | European Pat. Off. . |
| 518 840 | 12/1992 | European Pat. Off. . |
| 24 39 924 | 3/1975 | Germany . |
| 32 11 047 | 11/1982 | Germany . |
| 33 27 103 | 2/1984 | Germany . |
| 37 44 573 A1 | 7/1988 | Germany . |
| 14 91 612 A 1 | 7/1989 | U.S.S.R. . |
| WO A 90 05200 | 5/1990 | WIPO . |
| WO 91 05747 | 5/1991 | WIPO . |

OTHER PUBLICATIONS

Kiefffer, R.: Hartmetalle, Springer–Verlag, 1965 S. 228, 232–239, Wien–New York (no month).

Hwang, K.S.et al:Reaction Sintering of 0.1% B Doped Ni3Al, vol. 24. No. 5, 1992 (no month).

Konig, U. Advances in the Coating of Tools, vol. 24, No. 5, 1992, 297–302 (no month).

Japanese Abstracts JP A 03 267 304 (no month).

Japanese Abstracts CN A 1 050 908 (no month).

*Primary Examiner*—Archene Turner

*Attorney, Agent, or Firm*—Herbert Dubno

[57] ABSTRACT

The invention concerns composites substantially consisting of: a cermet material having a binder metal phase of between 5 and 30 mass % and the remainder comprising at least one carbon nitride phase; or a hard metal with a hard material phase of between 70 and 100 %, the remainder being a binder metal phase, with the exception of a WC-Co hard metal, with up to 25 mass % cobalt as binder metal; or a powder-metallurgically produced steel. The invention further concerns a process for producing this composite. In order to improve bending strength and hardness, sintering is carried out in a microwave field.

26 Claims, 1 Drawing Sheet

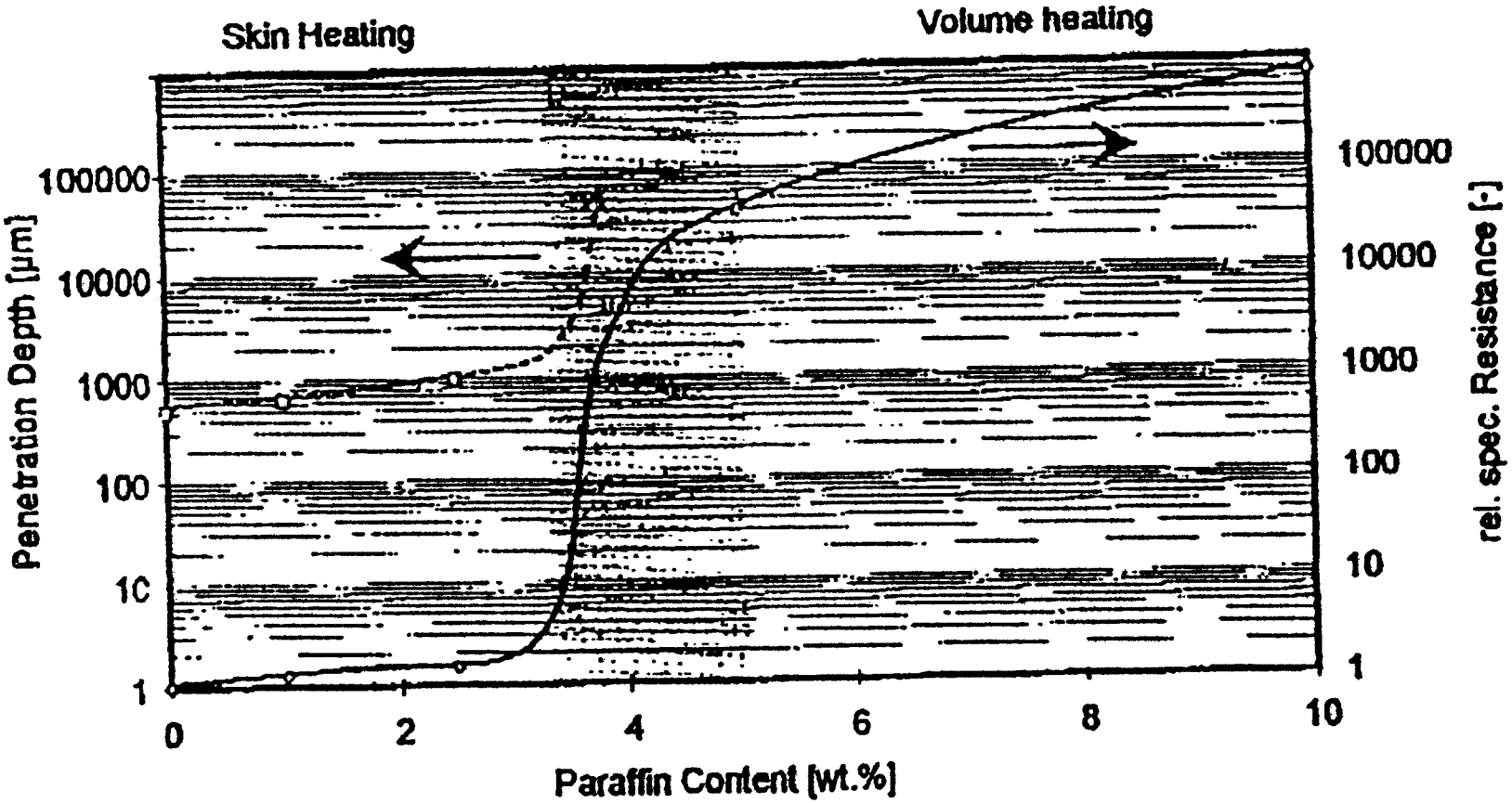
Skin Heating
Volume heating
Penetration Depth [µm]
100000
10000
1000
100
10
1
rel. spec. Resistance [-]
100000
10000
1000
100
10
1
0
2
4
6
8
10
Paraffin Content [wt.%]

COMPOSITE AND PROCESS FOR THE PRODUCTION THEREOF

CROSS REFERENCE TO RELATED APPLICATIONS

This application is a national phase of PCT/DE95/00548 filed Apr. 26, 1995.

FIELD OF THE INVENTION

The invention relates to a composite material, consisting substantially of

- a cermet material with a binder metal phase of 5 to 30 % by mass, the balance being a carbon nitride phase or
- a hard metal with a hard material phase of 70 to 100%, the balance being a binder metal phase, except for a WC-CO hard metal with up to 25% by mass cobalt as binder metal or
- a steel produced through the process of powder metallurgy.

The invention further relates to a process for the production of this composite material.

BACKGROUND OF THE INVENTION

Composite materials of the mentioned kind are mostly used as cutting plates for machining operations or as materials resistant to high temperatures. According to the state of the art materials of the above-mentioned kind are produced through the sintering of pressed bodies made of the corresponding mixtures of hard substances and metal powders, or just of metal powders. The sintering takes place in heatable ovens, which for instance are equipped with graphite heating elements, whereby the heating of the samples takes place indirectly by the radiation emitted by the heating elements, as well as by convection or heat conduction. The drawback of this process is in that the selection of the oven atmosphere is limited by the chemical properties of the heating elements. Furthermore the heating of the hard metals, cermets or steel takes place from the outside in and is substantially controlled by the heat conduction capability and the emissivity of the samples. Depending on the heat conductivity of the samples, the variation range of the heating and cooling ratios is strongly limited, and for this reason expensive steps, and apparatus are required for a satisfactory sintering of for instance ultra-fine hard metals.

In the CN 1050908 it has already been proposed to sinter a WC-CO hard metal with 6% by mass and a small addition of 0.5% by mass TaC in a hydrogen atmosphere at 1250° C. for 10 to 20 minutes in a microwave field, but this process seemed to be limited to such bodies which have only a small metal content. In the case of massive metallic bodies it has been specifically stressed that these can practically not be heated by the microwave. Moreover they reflect the irradiation effect even at the surface areas, due to their high electric conductivity and to the occurring eddy currents.

OBJECT OF THE INVENTION

It is the object of the present invention to improve the bending strength and hardness of a composite material as mentioned in the introduction and to indicate a process for the production of such a composite material.

DESCRIPTION OF THE INVENTION

This object is achieved with a composite material which, according to the invention, is produced by sintering in a microwave field. It has namely been surprisingly found that with higher contents of metal binder in the prefabricated pressed body, it has become possible to increase the efficiency of microwave heating also in hard metals. Microwave-sintered cermet materials, as well as microwave-sintered steel produced through the process of powder metallurgy have so far not even been mentioned in the technical literature. In contrast to the heretofore used conventional sintering, the microwave sintering represents a direct heating in bulk of composite materials of any desired geometry, with the only rule to be observed that the size of the sinter bodies lie within the order of magnitude of the wavelength of the used microwave radiation. In contrast to the heretofore existing practice, also bigger components can be sintered without pressure, since the high variability of the heating conditions allows for an intended structural setting in the entire component. Although the composite materials with good electrical conductivity reflect a part of the microwave radiation depending on their content of metal binder phase, the particular microstructure, especially in porous hard metal and cermet greens, makes possible a high depth penetration of the microwave radiation in the precompacted pressed body at already low temperatures.

Advantageous, from the point of view of a higher density, when the composite materials are additionally subjected to a final hot isostatic pressing (HIP), preferably at a pressure between 5 bar and 3000 bar at temperatures of 1200° C. to 1750° C. Hot isostatic pressing is basically known and is described for instance in the "Pulvermetallurgie for Hartmetalle" ("Powder Metallurgy of Hard Metals"), by H. Kolaska, Fachverband Pulvermetallurgie (Technical Association of Powder Metallurgy), 1992, Page 6/11 f.

Regarding the selection of materials, cermets which are carbonnitrides of titanium, zirconium, hafnium, vanadium, niobium, tantalum, chrome, molybdenum and/or tungsten and have a binder metal phase of cobalt and/or nickel have proven to be effective.

Hard metals with a hard material phase consisting of oxycarbides, oxynitrites, oxycarbonitrides or borides have also proven to be effective. The same applies to hard metals with hexagonal tungsten carbide as a first phase and a cubic mixed carbide of tungsten, titanium, tantalum and or niobium as a second phase and a binder metal phase of cobalt, nickel, iron or mixtures thereof. The aforementioned hard metals can also have a hexagonal mixed carbide phase of tungsten carbide with molybdenum carbide, instead of the pure hexagonal tungsten carbide phase.

The binder metal phase normally consisting of iron, cobalt and/or nickel can contain up to 15% by mass molybdenum, tungsten, titanium, manganese and/or aluminum. Particularly a nickel-aluminum alloy with a nickel/aluminum ratio of 90:10 to 70:30 can be used as a metal binder phase. Admixtures up to 1% by mass boron are possible with the mentioned metal binder phase.

Alternately the binder metal phase can also consist of the binder metal phase consists of at least one of $Ni_3Al$, $TiSi_3$, $Ti_2Si_3$, $Ti_3Al$, $Ti_5Si_3$, TiAl, $Ni_2TiAl$, $TiSi_2$, NiSi, $MoSi_2$, $MoSiO_2$, or mixtures thereof. Thereby additions of 0 to 16% by mass of cobalt, nickel, iron or rare-earth elements can also be contained.

According to a further embodiment of the invention a heat resisting binder metal phase can consist of high speed steel produced through the process of powder metallurgy and/or by super alloying. Also corrosion resistant binder metal phases of nickel and chroming, which optionally contain also additions of molybdenum, manganese, aluminum, silicon and/or copper of 0.01 to 5% by mass, have proven to be effective.

According to a further embodiment of the invention the composite material can have one or more surface layers, which have been applied through PVD, CVD or PCVD processes, preferably in a microwave field.

During the heating of a precompressed formed body in a microwave field, a controlled temperature increase of the sample body can already be achieved at low temperatures. At low temperatures of the sintered compact (up to approximately 1000° C.) and at low or medium microwave radiation outputs, eddy currents play a big part. The special characteristics of the microwaves further allow, through a simple adjustment of the output and the proper material selection, the additional induction of a plasma heating, which can be enhanced or inhibited, according to need. Depending on the surface temperature of the sintered compact, the plasma heating can be dispensed with, in order to prevent the danger of overheating the surface of the sintered compact. In this way an evaporation of the metallic components of the sintered compact can be avoided.

At low temperatures of the sintered compact, the process of the invention is based on the use of the so-called "skin effect". In mixtures of electrically conductive individual components, depending on the granulation and phase distribution, each single particle is heated by an eddy current, whereby the volume heated by the microwaves lies within the order of magnitude of the sample volume. In this way based on the microstructure of the sintered compact not only a thin boundary layer of the sintered compact is heated, but the microwave radiation can penetrate the sample. At higher temperatures, and especially when minimal amounts of a melting phase are formed, the microwave radiation can be directly converted into heat throughout the entire sintered compact due to relaxation processes, whereby any desired heating rates are possible. It is thereby possible to vary a physical process, such as the dissolution and elimination of phases, to a much larger extent than in conventional sintering. Furthermore a complete densification of the sintered compact is possible at shorter residence times. Also the speed of chemical reactions is positively influenced by the microwave energy. In general microwave sintering makes possible an optimization of the properties to a far greater extent than this could ever be possible with the known conventional heat treatments. Especially the limits for the hardness, the corrosion resistance, the magnetic, electric and thermomechanical characteristics for known compositions can be considerably improved.

The precompressed formed bodies can be heated either with a continuous heating rate or with a heating rate applied in pulses, whereby the heating rate equals 0.1 to $10^{4}$° C./min.

The sintering at a constant temperature following the heating is preferably carried out over a period of 10 to 60 minutes.

For the production of hard metals and cermets as green bodies plastifiers such as wax are used, which are eliminated during the heating. This process step can be performed independently of whether the used kinds of wax themselves absorb the microwave radiation, or are transparent to the microwaves, which is normally the case with the types of wax used. Depending on whether it is desired that the microwave reach the precompressed formed body over all its surfaces, the formed body can be respectively the formed bodies can be placed on a support of microwave-transparent material, such as aluminum oxide, quartz, glass or boron nitride, or on a support of microwave-absorbing material, such as carbon, silicon carbide, zirconium dioxide, tungsten carbide or tungsten carbide-cobalt. Further through the selection of the materials for the supports and the oven space, in addition to the direct microwave heating an indirect heating of the formed bodies due to the microwave heating of the supports and the oven space can take place.

The sintering can be performed in a vacuum, an inert gas atmosphere or in a reducing atmosphere, whereby as inert gases especially argon, in special cases also helium, can be considered. Helium can optionally be used for the inhibition of plasma. The mentioned inert gas atmospheres can advantageously contain up to 5% hydrogen.

As reducing atmospheres hydrogen, carbon monoxide, methane or mixtures thereof are available. The sintering pressure should not surpass 200 bar.

For the application of surface coatings there are two possibilities: The first consists in performing the PVD, CVD or PCVD coating without an intermediate cooling following the sintering, preferably by changing the gas composition. Alternatively it is also possible to perform the sintering process and/or the HIP process and the coating process in separate installations.

According to a further embodiment of the invention, for the purpose of controlling the penetration depth of the used microwave radiation, inert organic and inorganic additives with low dielectric losses can be added to the formed body. As in the case of hard metals or cermets, these can be plastifiers which have been added to the green bodies and which do not absorb microwave radiation. These additives control the penetration depth of the microwave radiation in such manner, that depending on the amount and the spatial distribution of these additives, the percolation degree of the strongly absorbent parts of the green body are reduced. The resulting reduction of the electric conductivity of the green body leads to the increase of the depth of penetration. Further through a special distribution of the nonabsorbent binders and additives, the formation of microstrip-like structures can be produced between these binders and additives and the electrically conductive components of the green bodies. Thereby a penetration of the green body by the microwave radiation along the microstrip-like structures is achieved, which makes possible a further increase of the penetration depth.

SPECIFIC EXAMPLES

In the following the invention is described in greater detail with the aid of embodiment examples.

Pressed bodies for indexable inserts, consisting of 25% by weight cobalt with a content of 1.5% by weight wax as plastifiers, the balance being WC, are arranged with an even distribution according to the oven geometry and heated by means of microwaves at a power density of 0.3 W/cm$^3$. The temperature control takes place by setting the microwave output. The pressed bodies rest on supports of $Al_2O_3$ in a container also made of $Al_2O_3$, which at the same time serves as a heat-insulating shell. As an inert gas atmosphere argon is used initially, and starting from 350° C. a mixture of argon and hydrogen with 5% hydrogen content is used. The heating rate up to 350° C. equals 0.1 to a maximum of 3° C./min. With this heating, the plastifier is completely burnt out, wherefore the heating rate is increased, namely to 15° C./min up to 1000° C. and to 50° C./min between 1000° C. and 1250° C. After that a rest period of 10 minutes was kept before the indexable inserts were cooled down at a rate of 20° C./min.

The sintered indexable inserts have a high hardness, a good bending resistance and a Weibull distribution according to the following table.

Results of Microwave Sintering of WC-Co 25% by Weight

| Characteristics | Microwave Sintering | Conventional Sintering |
|---|---|---|
| Bending resistance $\sigma_B$ | 3017 | 2620 |
| Weibull-Modulus | 24.8 | 16 |
| Hardness $H_{V30}$ | 836 | 798 |

For the improvement of the wear resistance it is possible to coat hard metals and cermets or even steels with hard materials. So for instance directly during the cooling period of the sintered compact, a chemical sample treatment can take place, especially through further microwave plasma atmosphere. As soon as the liquid phase solidifies, the relaxation of the microwave radiation is no longer an effective heat producing process in volumes of hard metals and cermets. Heat is produced only in the marginal area of the sintered compact by eddy currents. This creates the premises for using the irradiated microwave power for maintaining the microwave plasma, without causing an undesirable overheating of the sintered compacts. This process is possible in PVD coatings and can be performed here as an integrated process immediately after sintering. Special advantages result also from the use of microwaves for sintering hard metals and cermets when a final CVD coating is performed. Since following a cooling phase the sintered compacts are hotter than the surroundings, the CVD reaction takes place advantageously on the sintered compacts. Further in contrast to the conventional sintering process, it is not necessary to take into account the chemical properties of the heating elements when selecting the oven atmosphere.

The production of hard metals and cermets through heating by microwaves leads to a considerable simplification of the production process and thereby to a considerable shortening of the entire process duration. The heating rates can be kept within the range of $10^{-1}$° C./min for the dewaxing up to $5 \cdot 10^{3}$° C./min at temperatures over 1000° C. The cooling does not depend primarily on the thermal mass of the oven, but on the thermal mass of the charge to be sintered. Advantageously after sintering the oven is immediately available for a new charge.

As can be seen from the dependence of the electric conductivity of a hard-metal green body on the parts of binder by weight, illustrated in the sole Figure, at approximately 4% parts paraffine by weight the percolation limit of the conductive components of the green body is reached. With this paraffine proportion the penetration depth of the microwave radiation is increased in jumps and reaches values which are typical for volume heating.

We claim:

1. An article consisting essentially of a composite material selected from the group which consists of:

a cermet material with a binder phase of 5–20% by mass, the balance being at least one carbonitride phase;

a hard metal with a hard material phase of 70 to 100% by mass, the balance being a binder metal phase and excluding tungsten carbide-cobalt hard metal with up to 25% by mass cobalt as a binder metal; and a powder metallurgy steel, bulk sintered throughout the body of the article in a microwave field by direct microwave irradiation of the article.

2. The article defined in claim 1 wherein the body has been subjected to hot isostatic pressure between 5 bar and 3000 bar at a temperature of 1200° C. to 1750° C.

3. The article defined in claim 1 wherein said composite material is a cermet having a carbonitride phase based on Ti, Zr, Hf, V, Nb, Ta, Cr, Mo and/or W and a binder metal phase of Co and/or Ni.

4. The article defined in claim 1 wherein said composite material is a hard metal material selected from the group which consists of oxycarbides, oxynitrides, oxycarbonitrides and borides.

5. The article defined in claim 1 wherein said composite material is a hard metal having hexagonal WC as a first phase and cubic carbide of the mixed crystal of at least one of W, Ti, Ta and NB as a second phase and a binder metal phase of Co, Ni, Fe or mixtures thereof.

6. The article defined in claim 1 wherein said composite material is a hard metal consisting of hexagonal mixed carbides WC with at least one of MoC and cubic mixed carbides of the elements Ti, Zr, Hf, V, Nb, Ta, Cr, Mo and W with a binder metal phase of Co, Fe and Ni.

7. The article defined in claim 1 wherein the binder metal phase contains up to 15% by mass Mo, W, Ti, Mn or Al in relation to the total mass of the binder metal phase.

8. The article defined in claim 1 wherein the binder metal phase consists of a Ni—Al alloy with an Ni—Al proportion of 90:10 to 70:30.

9. The article defined in claim 1 wherein the binder metal phase contains up to 1% by mass boron in relation to the total mass of the binder metal phase.

10. The article defined in claim 1 wherein the binder metal phase consists of $Ni_3Al$, $TiSi_3$, $Ti_2Si_3$, $Ti_3Al$, $Ti_5Si_3$, TiAl, $Ni_2TiAl$, $TiSi_2$, NiSi, $MoSi_2$, $MoSiO_2$, and mixtures thereof.

11. The article defined in claim 10, further comprising an additive in an amount up to 16% by mass of cobalt, nickel, iron or a rare earth metal.

12. The article defined in claim 1 wherein said composite material is a high speed or super alloy steel.

13. The article defined in claim 1 wherein said binder metal phase comprises nickel and chromium.

14. The article defined in claim 1 further comprising an additive of at least one of Mo, Mn, Al, Si and Cu in an amount of 0.01 to 5% by mass.

15. The article defined in claim 1 further comprising at least one PVD, CVD or PCVD coating on said body applied in a microwave field.

16. A method of making an article consisting essentially of a composite body comprising the steps of shaping a powdered body of a composite material selected from the group which consists of:

a cermet material with a binder phase of 5–20% by mass, the balance being at least one carbonitride phase;

a hard metal with a hard material phase of 70 to 100% by mass, the balance being a binder metal phase and excluding tungsten carbide-cobalt hard metal with up to 25% by mass cobalt as a binder metal; and a powder metallurgy steel, prepressing said powdered body; and bulk sintering the pressed powdered body in a microwave field by direct microwave irradiation of the article with an energy density of 0.01 to 10W/cm$^2$.

17. The method defined in claim 16 wherein said body is heated continuously with a heating rate of 0.1 to $10^{4}$° C./min for sintering.

18. The method defined in claim 16 wherein the body is heated in pulses with heating rates of 0.1 to $10^{4}$° C./min.

19. The method defined in claim 16, further comprising the step of heating said body at a constant temperature for 10 to 60 minutes following sintering thereof.

20. The method defined in claim 16, further comprising the step of compounding said composite material with a plastifier, said plastifier being eliminated by microwave heating from said body.

21. The method defined in claim 16, further comprising the step of supporting said body on a microwave transparent material selected from the group which consists of $Al_2O_3$, quartz, glass and boron nitride.

22. The method defined in claim 16, further comprising the step of supporting said body on a microwave absorbent material selected from the group which consists of carbon, silicon carbide, zirconium dioxide, tungsten carbide, tungsten carbide-cobalt for microwave treatment of said body.

23. The method defined in claim 16 wherein the microwave sintering is carried out in an inert gas atmosphere containing 5% by volume $H_2$.

24. The method defined in claim 16 wherein the microwave sintering is carried out in a reducing atmosphere of at least one gas selected from the group which consists of hydrogen, carbon monoxide and methane.

25. The method defined in claim 16 wherein the sintering is carried out at a pressure of at most 200 bar.

26. The method defined in claim 16, further comprising the step of vapor depositing a coating on said body immediately after sintering and without cooling.

* * * * *